US009895584B1

(12) United States Patent
Su

(10) Patent No.: US 9,895,584 B1
(45) Date of Patent: Feb. 20, 2018

(54) COMPOSITE MATERIAL INTEGRALLY FORGED IRON HEAD OF A GOLF CLUB

(71) Applicant: Chi-Hung Su, Tainan (TW)

(72) Inventor: Chi-Hung Su, Tainan (TW)

( * ) Notice: Subject to any disclaimer, the term of this patent is extended or adjusted under 35 U.S.C. 154(b) by 0 days.

(21) Appl. No.: 15/378,445

(22) Filed: Dec. 14, 2016

(51) Int. Cl.
*A63B 53/04* (2015.01)

(52) U.S. Cl.
CPC .... *A63B 53/047* (2013.01); *A63B 2053/0416* (2013.01); *A63B 2053/0433* (2013.01); *A63B 2053/0491* (2013.01)

(58) Field of Classification Search
CPC ..... A63B 60/02; A63B 2053/0491; A63B 2053/0433; A63B 2053/0416; A63B 2053/042; A63B 2053/0425; A63B 2053/0429; A63B 53/047
See application file for complete search history.

(56) References Cited

U.S. PATENT DOCUMENTS 5,184,823 A * 2/1993 Desboilles ..... A63B 53/04 473/345
5,499,819 A * 3/1996 Nagamoto ..... A63B 53/04 473/346
5,540,436 A * 7/1996 Boone ..... A63B 53/00 473/350
5,697,855 A * 12/1997 Aizawa ..... A63B 53/04 473/332
7,938,738 B2 * 5/2011 Roach ..... A63B 53/047 473/329
9,421,435 B2 * 8/2016 Jertson ..... A63B 53/047
2005/0130764 A1 * 6/2005 Frame ..... A63B 53/0487 473/340
2006/0199661 A1 * 9/2006 Deng ..... A63B 53/047 473/324
2007/0042834 A1 * 2/2007 Nicolette ..... A63B 53/047 473/334
2015/0111660 A1 * 4/2015 Wu ..... A63B 53/047 473/331
2015/0306473 A1 * 10/2015 Breier ..... A63B 53/0466 473/336

* cited by examiner

*Primary Examiner* — John E Simms, Jr.
(74) *Attorney, Agent, or Firm* — Rosenberg, Klein & Lee

(57) ABSTRACT

A composite material integrally forged iron head of a golf club includes a head body, a weight part and a cover. The head body has an engaging recess formed inside. The weight part is mounted in the engaging recess and the material of the weight part is composite ceramics and has a density of 1.3 to 3.5 g/cc. The cover is welded on the engaging recess of the head body, and the weight part is sealed by the head body and the cover without any gap. The integrally forged iron head has a lower density in the center and a higher density in the surrounding area, which increases the error tolerance and enlarges the sweet-spot area, and also improves the sound and feel of striking.

3 Claims, 8 Drawing Sheets

COMPOSITE MATERIAL INTEGRALLY FORGED IRON HEAD OF A GOLF CLUB

BACKGROUND OF THE INVENTION

1. Field of the Invention

The present invention relates to an iron head of a golf club, especially to a composite material integrally forged iron head of a golf club.

2. Description of Related Art

A conventional iron golf club head is mostly manufactured by forging or casting with one single steel material. Because the material properties lack diversity, the strike performance of the iron golf club head is limited. Therefore, to enhance the strike performance, the iron golf club head must be lightweight and large in volume, so a weight part is installed in the iron golf club head to adjust the density and to increase the properties of the iron golf club head.

The conventional iron golf club heads has several types as follows:

1. Integrated Forged or Cast Iron Head

The materials of the iron golf club head include carbon steel, stainless steel or titanium, which are applied in an integrated forging or casting process. The density of the carbon steel is around 7.7 g/cc to 7.9 g/cc, and the density of the stainless steel is around 7.6 g/cc to 7.8 g/cc. The densities of both of the steel materials are heavy such that it is hard to reduce the weight and increase the volume of the iron golf club head in manufacture. The titanium material can be made of a large-volume iron golf club head, and the density of the titanium material is around 4.5 g/cc. However, the material and manufacturing of a titanium iron golf club head costs too high and can hardly gain the market acceptance.

2. Composite Aluminum Alloy Material Forged Iron Head

The aluminum composite iron golf club head includes a head body and a weight part. The head body is made of carbon steel or stainless steel and is combined with the weight part made of aluminum alloy by forging. The aluminum alloy material has a density of around 2.5 g/cc and has a suitable weight as an ideal material for producing the iron golf club head. In a forging process, the forging temperature is usually from 700 to 1200° C. and the melting point of the aluminum alloy material is only from 650 to 680° C., so the structure of the weight part will be damaged and will not be combined with the head body tightly by forging. The strike performance of the golf iron head is also influenced by the manufacturing process.

3. Composite Titanium Alloy Material Forged Iron Head

The titanium composite iron golf club head includes a head body and a weight part. The head body is made of carbon steel or stainless steel and is combined with the weight part made of titanium alloy by forging. The weight part has a density of around 4.5 g/cc of with good physical properties, but titanium alloy costs higher than other materials and the manufacturing process is complicated, making the price of the iron head product beyond market acceptance. Also, the density of the titanium alloy is slightly less than the density of carbon steel or stainless steel, and thus the weight of the iron golf club head cannot be decreased and the volume of the iron golf club head cannot be increased substantially.

To overcome the shortcomings of the conventional manufacture method, the present invention provides a manufacturing method of an iron golf club head to mitigate or obviate the aforementioned problems.

SUMMARY OF THE INVENTION

The main objective of the present invention is to provide a composite material integrally forged iron head of a golf club.

The composite material integrally forged iron golf club head includes a head body, a weight part and a cover. The head body has an engaging recess formed inside. The weight part is mounted in the engaging recess and the material of the weight part is composite ceramics and has a density of 1.3 to 3.5 g/cc. The cover is welded on the engaging recess of the head body, and the weight part is sealed by the head body and the cover without any gap.

The integrally forged iron head has a lower density in the center and a higher density in the surrounding area, which increases the error tolerance and enlarges the sweet-spot area, and also improves the sound and feel of striking.

Other objects, advantages, and novel features of the invention will become more apparent from the following detailed description when taken in conjunction with the accompanying drawing.

DETAILED DESCRIPTION OF PREFERRED EMBODIMENT

With reference to FIG. 1 to 5, a first preferred embodiment of a composite material integrally forged iron head of a golf club includes a head body 10, a weight part 20 and a cover 30.

Figure 2:
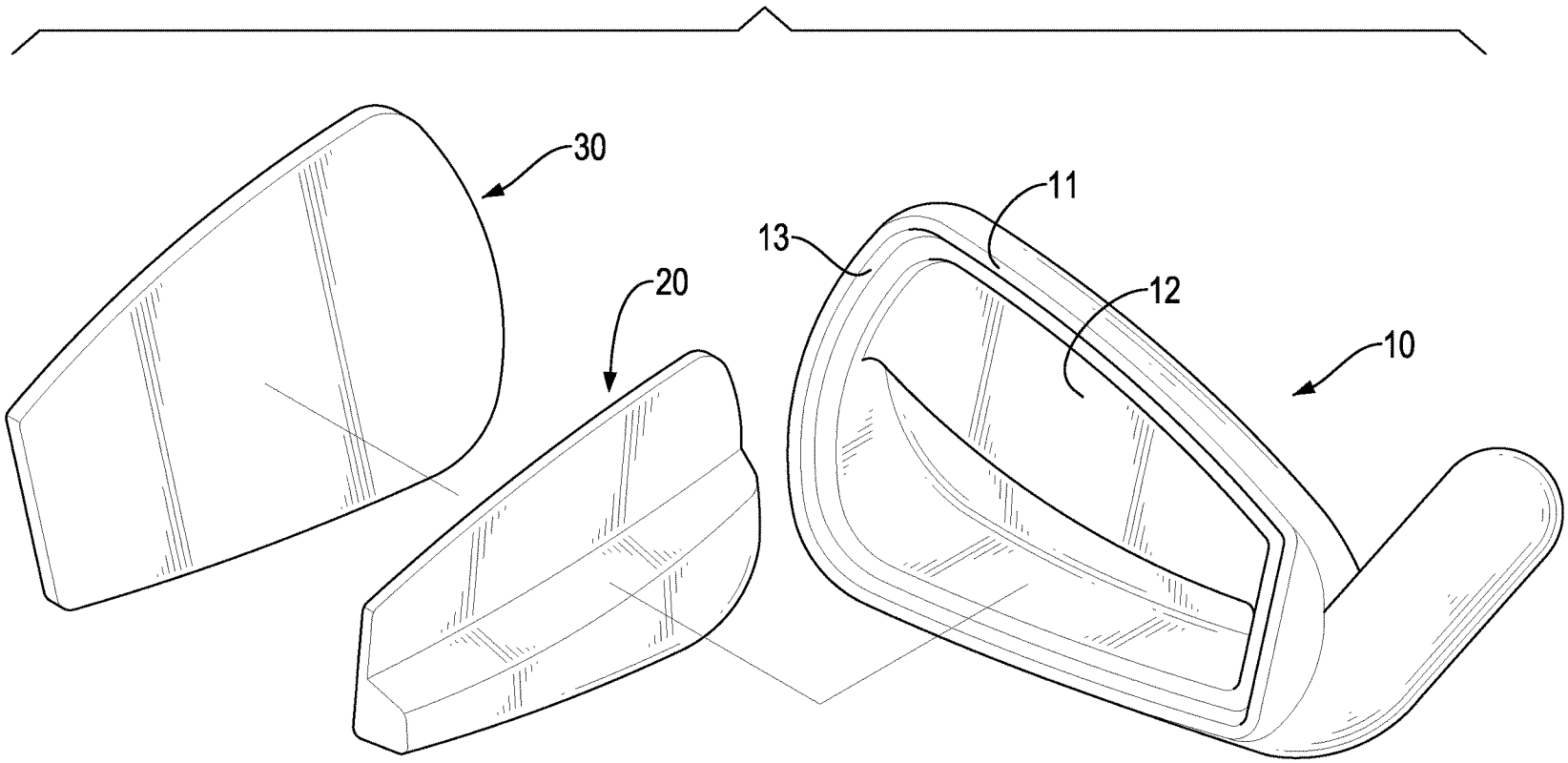
FIG. 2 is an exploded perspective view of a first preferred embodiment of the iron head made by the process in FIG. 1.
Figure 3:
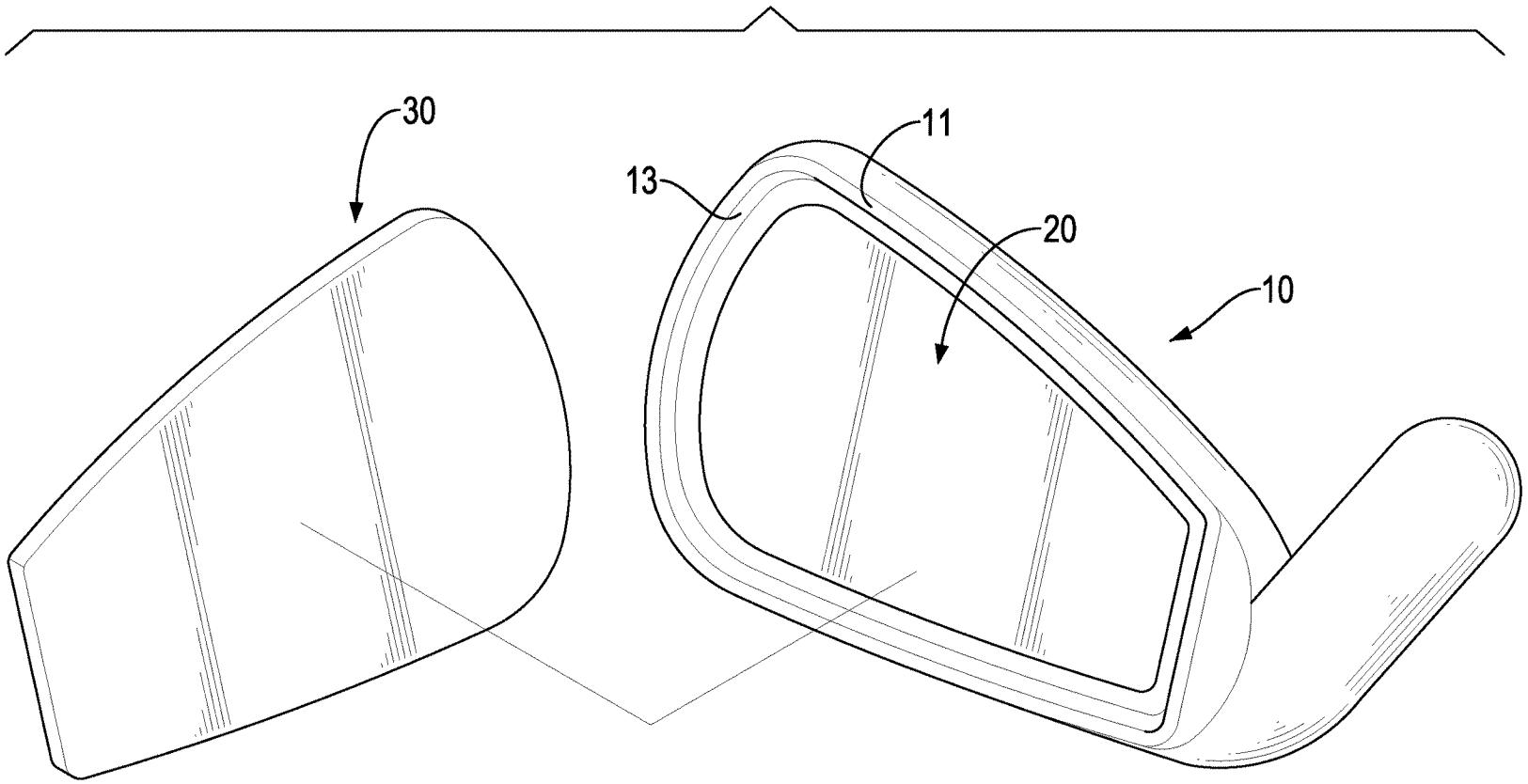
FIG. 3 is an exploded perspective view of a cover mounted on a head body of the iron head made by the process in FIG. 1.

With reference to FIGS. 2 and 3, the head body 10 has a strike face 11, an engaging recess 12 and a placing abutment 13. The engaging recess 12 is formed in the strike face 11 and is step-shaped. The placing abutment 13 is formed around the engaging recess 12. The material of the head body 12 can be selected from carbon steel, such as 1020C, 1025C, 1035C, 1045C, 35CrMo, or selected from stainless steel, such as SUS303, SUS304, SUS431, 17-4PH, or selected from alloy steel.

The volume and the shape of the weight part 20 correspond to those of the engaging recess 12, and the weight part 20 is mounted in the engaging recess 12. The material of the weight part 20 is composite ceramics. Preferably, the density of the weight part 20 is around 1.3 to 3.5 g/cc. The composition of the weight part 20 contains 60 to 70% of silicon oxide, 15 to 25% of zirconium oxide, and 10 to 20% of aluminum oxide with other chemical ingredients. The weight part 20 can change the percentage of the material composition to adjust the density of the weight part 20 and has high temperature resistance from 1400° C. to 2200° C.

The cover 30 is mounted on the placing abutment 13 of the head body 10 and is welded with the head body 10. The material of the cover 30 is same to the head body 10.

Figure 1:
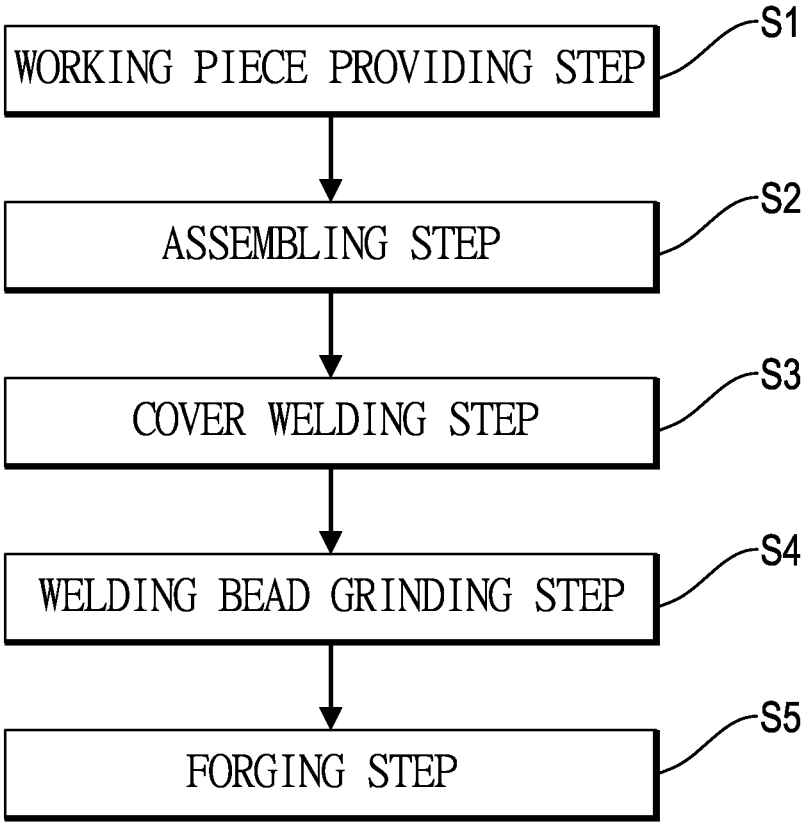
FIG. 1 is a block diagram of a manufacturing process of a composite material integrally forged iron head in accordance with the present invention.

With reference to FIG. 1, the manufacturing process of the composite material integrally forged iron head includes a working piece providing step S1, an assembling step S2, a cover welding step S3, a welding bead grinding step S4, and a forging step S5.

With reference to FIG. 2, in the working piece providing step S1, the head body 10, the weight part 20 and the cover 30 are provided.

With reference to FIG. 3, in the assembling step S2, the weight part 20 is mounted in the head body 10, and the cover 30 is covered on the weight part 20. A surface of the cover 30 is flush with the strike face 11 of the head body 10.

Figure 4:
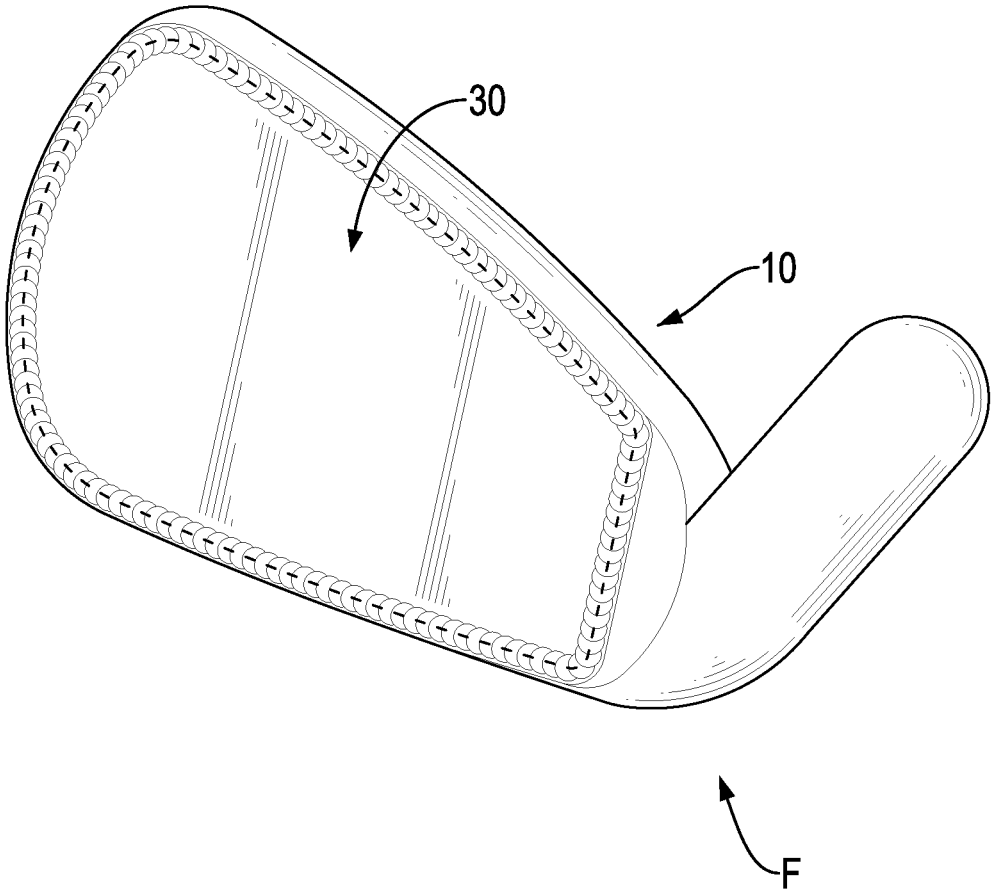
FIG. 4 is a perspective view of the welded cover with the head body of the iron head made by the process in FIG. 1.

With reference to FIG. 4, in the cover welding step S3, a gap between the cover 30 and the head body 10 is welded and a welding bead is formed in the gap. The weight part 20 is sealed between the cover 30 and the head body 10. The head body 10, the weight part 20 and the cover 30 are integratedly formed as a forging working piece F.

In the welding bead grinding step S4, the welding bead is ground and the whole forging working piece F is ground to a predetermined weight for a forging process.

Figure 5:
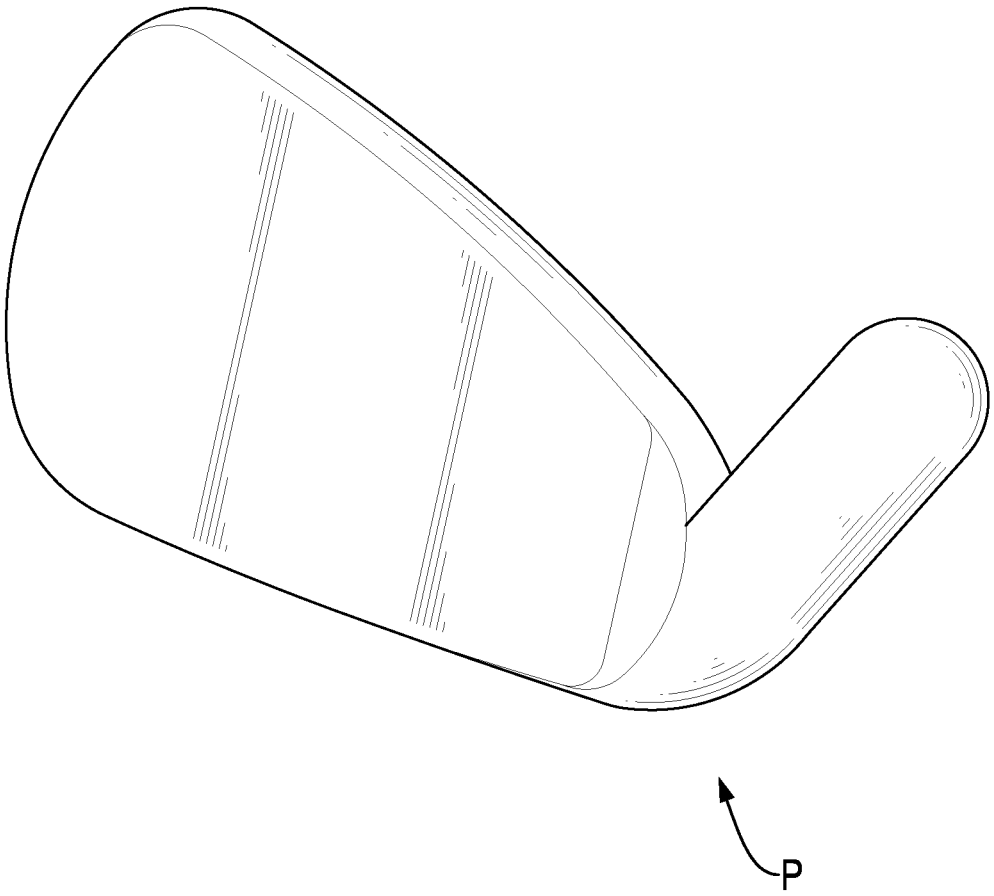
FIG. 5 is a perspective view of a semi-finished product of the iron head made by the process in FIG. 1.
Figure 6:
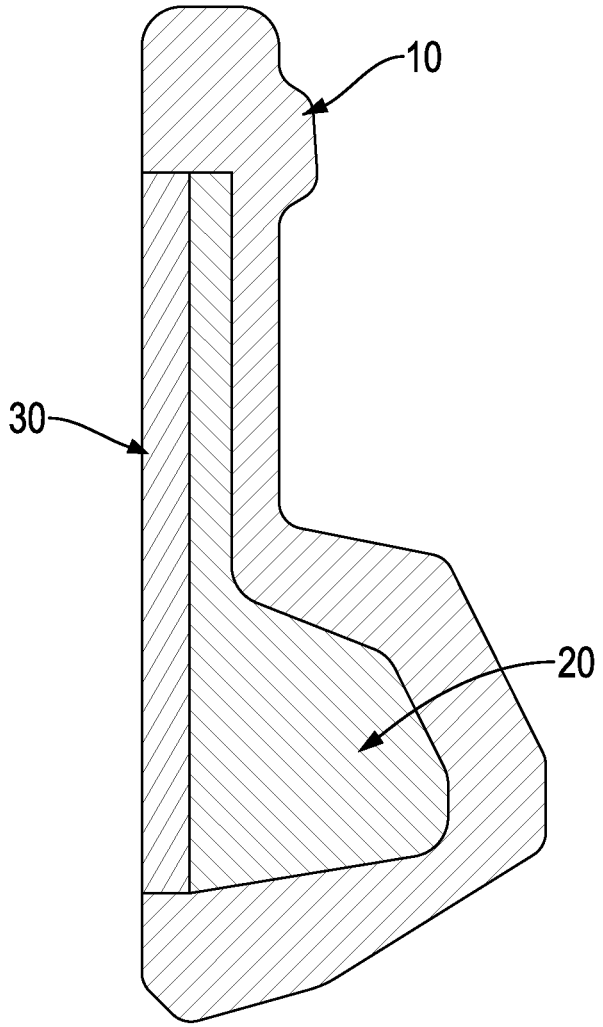
FIG. 6 is a cross sectional right side view of the semi-finished product of the iron head in FIG. 5.

In the forging step S5, the forging working piece F is pre-heated to 700° C. to 1200° C. and is placed in a forging die to forge. With reference to FIG. 5, after the forging process, a semi-finished product P is made and has 0.5 to 5 g burrs generated along the contour of the semi-finished product P.

With reference to FIG. 5, the semi-finished product P is the weight part 20 integrally covered by the head body 10 and the cover 30 firmly without any gap. Because the weight part 20 has high temperature resistance and low thermal expansion coefficient in material properties, the weight part 20 will not prone to deform and generate shrinkage cavities or pinholes. In the heat-treatment process, even though the density and the thermal expansion coefficient of the weight part 20 and those of the head body 10 are different, the weight part 20 and the head body 10 will not separate or generate a gap. As the weight part 20 has lower density, the semi-finished product P has a lighter weight compared to a single material forged iron head that has the same volume, or the semi-finished product P has a larger volume compared to a single material forged iron head that has the same weight.

When the semi-finished product P after processing becomes an iron golf club head that has a lower density in the center and a higher density in the surrounding areas, the error tolerance is increased and the sweet-spot area is enlarged, and also the sound and feel of striking are improved.

Figure 7:
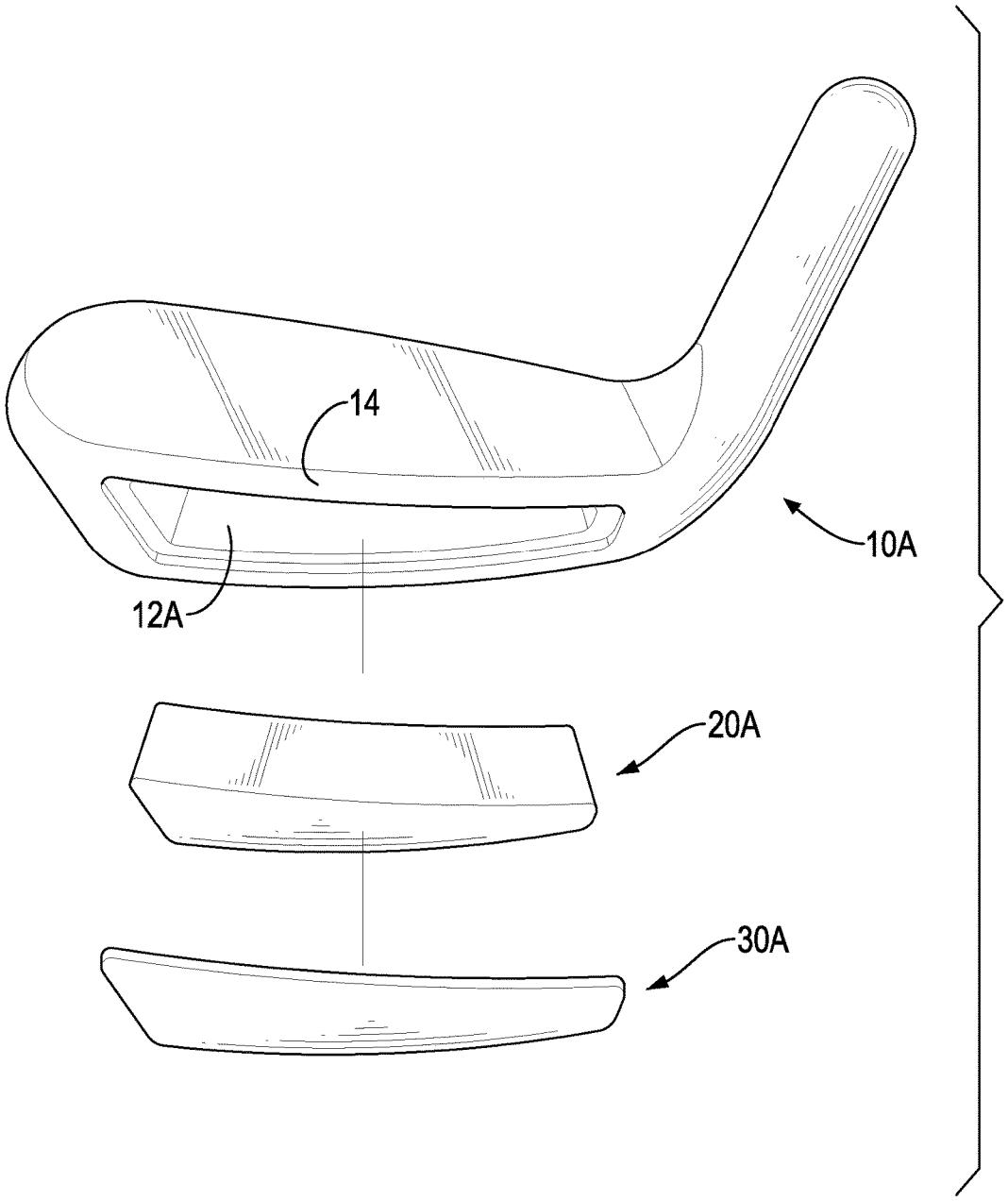
FIG. 7 is an exploded perspective view of a second preferred embodiment of the iron head in accordance with the present invention.
Figure 8:
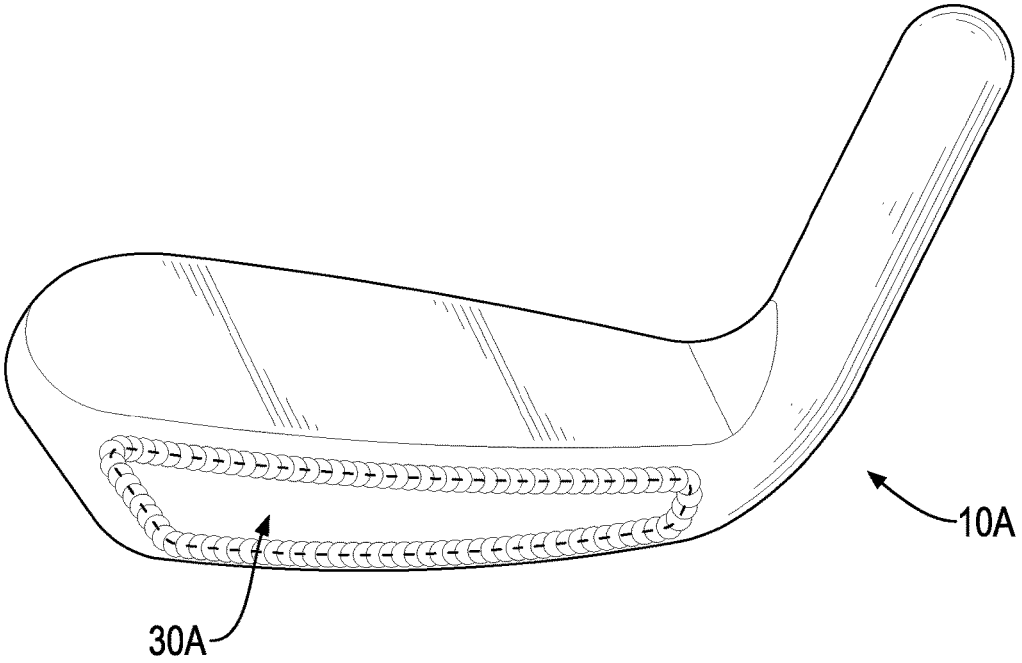
FIG. 8 is a perspective view of the welded cover with the head body of the iron head in FIG. 7.

With reference to FIG. 7, a second preferred embodiment of the composite material integrally forged iron head is similar to the first preferred embodiment. The difference is in shapes of a head body 10A, a weight part 20A, and a cover 30A The head body 10A has a sole and an engaging recess 12A formed in the sole. The weight part 20A is mounted in the engaging recess 12A. The cover 30A covers the weight part 20A and a surface of the cover 30A is flush with a surface of the sole. After the assembling step, the cover welding step, the welding bead grinding step, and the forging step, the weight part 20A is sealed between the head body 10A and the cover 30A as an integrated iron head. The engaging recess also can be formed in a back area of the head body to get same great effect.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A composite material integrally forged iron head of a golf club, the iron head comprising:

a head body having an engaging recess formed inside;

a weight part mounted in the engaging recess and the material of the weight part being composite ceramics and having a density of 1.3 to 3.5 g/cc;

a cover welded on the engaging recess of the head body and sealing the weight part between the head body and the cover without any gap, wherein the composition of the weight part contains 60 to 70% of silicon oxide, 15 to 25% of zirconium oxide, and 10 to 20% of aluminum oxide.

2. The iron head as claimed in claim 1, wherein the head body has a strike face, the engaging recess is formed in the strike face, and a surface of the cover is flush with the strike face of the head body.

3. The iron head as claimed in claim 1, wherein the head body has a sole, the engaging recess is formed in the sole, and a surface of the cover is flush with a surface of the sole.

* * * * *